US006193479B1

(12) United States Patent
Angoli

(10) Patent No.: US 6,193,479 B1
(45) Date of Patent: Feb. 27, 2001

(54) PUMP WITH STORAGE TANK

(75) Inventor: Giovanni Battista Angoli, Orzinuovi (IT)

(73) Assignee: Marinox Pompe di Angoli, Margherita (IT)

( * ) Notice: Subject to any disclaimer, the term of this patent is extended or adjusted under 35 U.S.C. 154(b) by 0 days.

(21) Appl. No.: 09/168,450

(22) Filed: Oct. 8, 1998

(30) Foreign Application Priority Data

Oct. 13, 1997 (IT) ..... BS970106 U

(51) Int. Cl.[7] ..... F04B 17/00; F04B 35/04
(52) U.S. Cl. ..... 417/423.5; 417/423.15
(58) Field of Search ..... 417/423.5, 423.15, 417/423.8; 422/242; 138/26, 30

(56) References Cited

U.S. PATENT DOCUMENTS 4,228,134 * 10/1980 Alfo ..... 422/208
4,667,841 * 5/1987 Belle ..... 220/22
5,152,212 * 10/1992 Chauveau ..... 99/348
5,333,660 * 8/1994 Kohlmann et al. ..... 141/263
5,368,073 * 11/1994 Murphy ..... 138/30
5,445,494 * 8/1995 Hanson ..... 415/107

* cited by examiner

*Primary Examiner*—Noah P. Kamen
*Assistant Examiner*—Mahmoud M Gimie
(74) *Attorney, Agent, or Firm*—McGlew and Tuttle, P.C.

(57) ABSTRACT

A pump with storage tank or autoclave, where the pump comprises a pump section driven by an electric motor and the tank with an internal membrane which divides it into a first collection chamber for the water and a second chamber containing a compressible gas. The pump section (12) is a multistage centrifugal type and intakes the liquid through an input (17) on the sealed side discharging it directly into the first chamber of the tank, the first chamber being in communication with an output passage to the point of use.

16 Claims, 1 Drawing Sheet

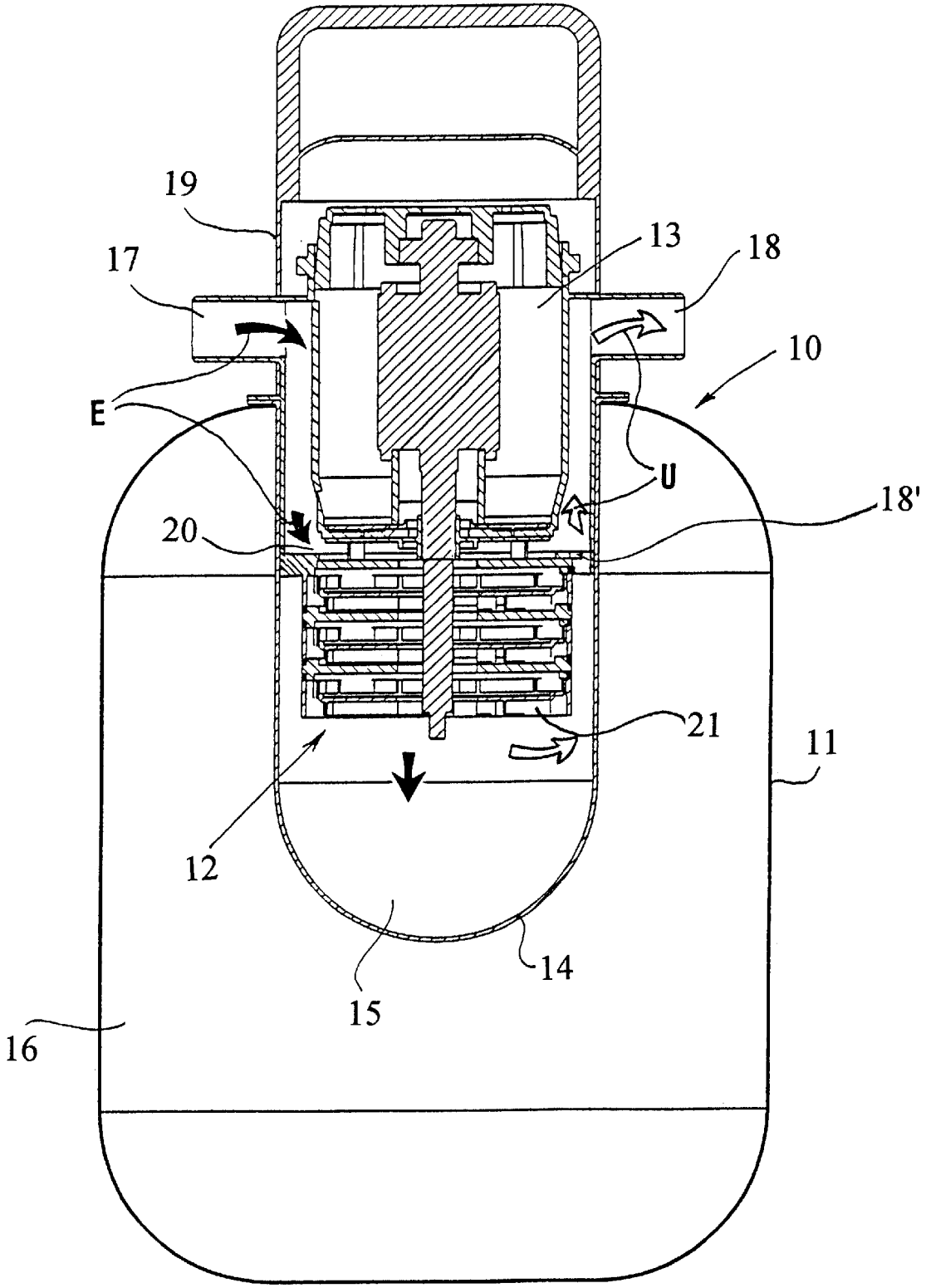
19
17
13
18
10
E
U
18'
20
21
11
12
14
15
16

PUMP WITH STORAGE TANK

FIELD OF THE INVENTION

The present invention concerns pumps, in particular storage tank type motor driven pumps also known as autoclaves.

BACKGROUND OF THE INVENTION

Certain types of pumps usually have a motor driven pump, which is connected to the storage tank by tubes and connections. This however makes the unit rather complex, bulky and costly.

SUMMARY AND OBJECTS OF THE INVENTION

The primary object of the present invention is to provide a pump with a storage tank which is simpler and less costly to make thanks to a new particular device and combination of components and furthermore the elimination of tubes and connections between the pump and tank.

Another object of the invention is to make a more compact pump-autoclave unit where the electric motor is cooled by the intake liquid and directed to the tank where the multistage centrifugal type pump operates: the layout being exactly opposite to the normal one used. It intakes from the sealed section and delivers the liquid to the tank creating a pressure; the fluid then being drawn off from the tank for use.

The advantages of a layout such as this are numerous. Foremost, the suction, which takes place from the sealed section, helps to shorten the distance the liquid has to travel in this phase.

Secondly, the pump section is always immersed in the liquid in the tank so it is permanently drawing, thus avoiding any inconveniences due to operating without load.

Also very beneficial and that which forms another innovative characteristic, is the suction placed in line with the output towards the point of use, enabling a handy and fast installation of the unit even in the area under the sink. The suitability of the pump for domestic use is also favored by the insulating effect the pump being immersed in water has.

The use of a centrifugal pump instead of self-priming pumps gives the equipment remarkable energy savings compared to normal consumption.

The pump with storage tank or autoclave proposed here is shown in the rough diagram and given as an example in the only FIGURE in the enclosed drawing and which will be described in more detail below.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWINGS

In the drawings:

The only FIGURE is a sectional view of a pump with storage tank or autoclave according to the invention.

DESCRIPTION OF THE PREFERRED EMBODIMENT

Referring to the drawings in particular, the pump is shown as 10 and the storage tank as 11. The pump has a multistage pump section 12 operated by an electric motor 13. The pump section has an intake side 20 and an open discharge side 21 opening directly into the tank 11. Internally, the tank 11 has, as is normal, a membrane 14 which divides it into a first chamber 15 to receive the fluid delivered from the pump section 12 and a second chamber 16 containing a gas which compresses with the increase of the fluid in the first chamber 15 to create the pressure enabling the liquid to be delivered to the point of use when required.

The pump section 12 and motor 13 are placed in a casing 19 with an inlet passage 17 of the suction liquid and an outlet passage 18 to point of use. The two passages 17, 18 are preferably placed on opposite sides in line with each other and at the same level as the motor 13.

The pump 10 and the tank 11 are assembled so that the pump section 12 discharges the liquid delivered by the intake passage 17 indicated according to the arrows E directly into the first chamber 15 delimited by the membrane 14 in tank 11. On the other side the first chamber 15 of the tank is in communication with the outlet passage 18 indicated by the arrows U on the drawing through an aperture 18'.

The results and advantages are those referred to above.

Furthermore, in the case of particular requirements the unit can be assembled using an air-cooled motor and with the pump in the autoclave. Lastly, an assembly can be provided with external pump having fixed hydraulic connections in the pump casing without reducing the scope of this invention.

While a specific embodiment of the invention has been shown and described in detail to illustrate the application of the principles of the invention, it will be understood that the invention may be embodied otherwise without departing from such principles.

What is claimed is:

1. A pump with storage tank/autoclave, comprising:

an electric motor;

a pump section driven by said electric motor; and a tank with an internal membrane which divides said tank into a first collection chamber for liquid and a second chamber containing a compressible gas, said pump section including a multistage centrifugal pump with an intake for liquid on a sealed side and with a discharge directly into said first collection chamber of the tank, said first collection chamber being in communication with an output passage to a point of use, said first chamber of said tank substantially surrounding said pump section.

2. The pump according to claim 1, wherein said pump section and said tank are assembled without connecting tubes or with hydraulic connections in the pump casing.

3. The pump according to claim 1 wherein said pump section is immersed in a liquid in said first chamber of the tank so as to be permanently drawing.

4. The pump according to claim 2 wherein said pump section is immersed in a liquid in said first chamber of the tank so as to be permanently drawing.

5. The pump according to claim 1, wherein the pump section and drive motor are placed in a casing having a fluid input passage on one side and the fluid output passage on the opposite side in line with each other.

6. The pump according to claim 5, wherein said input and output passages of the fluid are on a level with the motor and circulating liquid cools the motor.

7. The pump according to claim 1 wherein the motor is air-cooled and the pump is in an autoclave.

8. The pump according to claim 2 wherein the motor is air-cooled and the pump is in an autoclave.

9. The pump according to claim 3 wherein the motor is air-cooled and the pump is in an autoclave.

10. The pumping arrangement in accordance with claim 1, wherein:

said discharge of said pump section is open and opens directly into said first chamber of said tank.

11. A pumping arrangement comprising:

a tank with an internal membrane which divides said tank into a first chamber and a second chamber;

a compressible gas arranged in said second chamber;

a pump arranged in said first chamber of said tank, said pump having a intake side and a discharge side, said discharge side being open and opening directly into said first chamber of said tank, said intake side having an inlet passage receiving liquid from outside said tank; and a motor arranged in said first chamber of said tank and driving said pump;

said first chamber surrounds and insulates said pump and said motor.

12. The pumping arrangement in accordance with claim 11, wherein:

said pump is a non-self priming pump;

said first chamber has an outlet passage, said inlet passage and said outlet passage are arranged on said tank above said pump.

13. The pumping arrangement in accordance with claim 12, wherein:

said pump is a multistage centrifugal pump.

14. The pumping arrangement in accordance with claim 11, wherein:

said first chamber has an outlet passage, said inlet passage and said outlet passage open on substantially diametrically opposite sides of said tank and said pump.

15. The pumping arrangement in accordance with claim 11, further comprising:

a motor arranged in said first chamber of said tank and driving said pump.

16. The pumping arrangement in accordance with claim 15, wherein:

said first chamber has an outlet passage, one of said inlet passage and said outlet passage are arranged adjacent said motor for cooling said motor with liquid passing though said one passage.

* * * * *

UNITED STATES PATENT AND TRADEMARK OFFICE

CERTIFICATE OF CORRECTION

PATENT NO. : 6,193,479 B1
DATED : February 27, 2001
INVENTOR(S) : Giovanni Battiat Angoli It is certified that error appears in the above-identified patent and that said Letters Patent is hereby corrected as shown below:

(75) Inventor:
Giovanni Battista Angoli, Orzinuovi (Brescia) Italy

(73) Assignee:
Marinox Pompe di Angoli Margherita, Orizinuovi (Brescia), Italy

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*